US010172438B2

(12) United States Patent
Smith

(10) Patent No.: US 10,172,438 B2
(45) Date of Patent: Jan. 8, 2019

(54) FOLDING HYBRID VESSEL

(71) Applicant: Jay Howard Smith, Aromas, CA (US)

(72) Inventor: Jay Howard Smith, Aromas, CA (US)

( * ) Notice: Subject to any disclaimer, the term of this patent is extended or adjusted under 35 U.S.C. 154(b) by 315 days.

(21) Appl. No.: 14/992,001

(22) Filed: Jan. 10, 2016

(65) Prior Publication Data

US 2017/0106944 A1 Apr. 20, 2017

Related U.S. Application Data

(60) Provisional application No. 62/242,991, filed on Oct. 17, 2015.

(51) Int. Cl.

| | |
|---|---|
| ***A45F 4/10*** | (2006.01) |
| ***B63B 35/71*** | (2006.01) |
| ***B63B 7/04*** | (2006.01) |
| *B63B 7/00* | (2006.01) |

(52) U.S. Cl.

CPC ..... *A45F 4/10* (2013.01); *B63B 7/04* (2013.01); *B63B 35/71* (2013.01); *B63B 2007/003* (2013.01); *B63B 2007/006* (2013.01)

(58) Field of Classification Search

CPC .. A45F 4/10; B63B 7/04; B63B 35/71; B63B 2007/003; B63B 2007/006

See application file for complete search history.

(56) References Cited

U.S. PATENT DOCUMENTS

| | | | | |
|---|---|---|---|---|
| 3,453,669 | A * | 7/1969 | Purney, Sr. | B63B 7/04 114/352 |
| 3,648,309 | A * | 3/1972 | Novakovich | B63L 37/00 114/354 |
| 4,274,170 | A * | 6/1981 | Simpson | B63B 7/06 114/347 |
| 4,841,899 | A * | 6/1989 | Fleckles | B63B 7/06 114/347 |
| 2007/0295261 | A1* | 12/2007 | Flood | B63B 7/06 114/353 |
| 2010/0024710 | A1* | 2/2010 | Malone | B63L 37/04 114/353 |
| 2010/0058971 | A1* | 3/2010 | Rixford | B63B 7/04 114/352 |
| 2011/0017121 | A1* | 1/2011 | Willis | B63L 335/71 114/347 |
| 2012/0160149 | A1* | 6/2012 | Flood | B63L 37/082 114/353 |
| 2013/0200115 | A1* | 8/2013 | Huber | B63B 7/08 224/153 |
| 2015/0230591 | A1* | 8/2015 | Maybin | A45F 4/10 224/153 |

* cited by examiner

*Primary Examiner* — Christopher R Harmon

(57) ABSTRACT

A portable vessel includes a hard shell front hull section, a hard shell aft hull section, a flexible water tight material hull section affixed to the front hull section and the aft hull section in a water tight manner, the material section forming the middle portion of the hull of the vessel, and a tension-adjustable frame assembly. Tensioning of the frame assembly during assembly of the vessel causes tensioning of the material hull section from a less than taught state to a taught state about the frame assembly and wherein the disassembled components of the vessel may be configured into a backpack configuration for portage by a user.

23 Claims, 11 Drawing Sheets

FOLDING HYBRID VESSEL

CROSS-REFERENCE TO RELATED DOCUMENTS

The present invention claims priority to a U.S. provisional patent application Ser. No. 62/242,991 filed on Oct. 17, 2015 entitled "Folding Hybrid Vessel", disclosure of which is included herein at least by reference.

BACKGROUND OF THE INVENTION

1. Field of the Invention

The present invention is in the field of portable one or two person vessels and pertains particularly to methods and apparatus for quick assembly of a portable vessel for use and disassembly of the vessel for transport.

2. Discussion of the State of the Art

Rigid hull canoes, kayaks and other small vessels have been known about and used extensively for centuries however these vessels have the disadvantage of being difficult to transport because of their bulky size.

Inflatable vessels have the advantage of collapsibility but lack good performance in the water.

Folding type vessels have the advantage of collapsibility, however, the currently known designs come with drawbacks in weight, mechanical complexity, long setup time and inferior performance in the water compared to rigid hull counterparts.

What is needed is a light weight collapsible boat that performs comparably to rigid hull counterparts that can quickly and easily transformed to a relatively small package that can be transported such as on ones back, in the trunk of a car, or in a float plane.

BRIEF SUMMARY OF THE INVENTION

To meet the need for a folding vessel that is light weight may be quickly assembled and disassembled and able to perform comparably to a rigid hull type vessel in the water, a novel hull design is proposed with aspects of both folding type and rigid hull type vessels. The present invention is particularly directed toward a vessel that quickly collapses into a self-contained package of optimal shape, size, and ergonomic features to be carried on ones person.

A portable vessel includes a hard shell front hull section, a hard shell aft hull section. The front and aft hull sections are nested one into the other during portage. A flexible water tight material hull section is affixed to the front hull section and the aft hull section in a water tight manner, the material section forming the middle portion of the hull of the vessel, the material section allowing the hard shell front and aft hull sections to nest within the other without detachment of material hull section from the hard shell hull sections. A tension-adjustable frame assembly including at least one cross rib member and at least two floor boards, and at least four side panels, the floor boards connected linearly from the front hull to the aft hull section, the side panels connected linearly to the front and aft hull sections on each side of the hull, and to the at least one rib component, and in the case of more than 4 panels, strategic ones of the side panels connected together, wherein completion of the frame assembly causes tensioning of the material hull section from a less than taught state to a taught state about the frame assembly and wherein the flexible material skin and disassembled components of the vessel may be stored within the nested hull sections to form a self-contained package that may be a wearable backpack configuration for portage by a user.

In one embodiment, the front hull and aft hull sections are polymer shells with a reinforcement material that may include Kevlar (a synthetic fiber of high tensile strength used especially as a reinforcing agent in the manufacture of tires and other rubber products and protective gear such as helmets and vests), carbon fiber, fiberglass, composite material, Solid polymer, hollow polymer corrugated material with internal structural reinforcements, fiber reinforced polymer composite material or a composite material with low density core. Other suitable materials may be used without departing from the spirit and scope of the invention. In one embodiment the floor boards are secured over the nested hull sections by tension adjustable straps or mechanical latch retaining the side panels, the at least one cross rib member, and the flexible material hull therein. In this embodiment, one or more of the floor boards may include a layer of padding material on at least one surface. The floor boards with the padding material may be used as a backboard in a backpack configuration and may include carrying straps. The padding material ergonomically conforming to ones back during portage. In one embodiment, the padding material includes at least two ergonomic indentations adapted to interface the knees of an operator paddling the vessel from the middle of the vessel. In one embodiment, space is allocated within the nested hull sections for transport of additional items such as fishing equipment and camping gear. In another embodiment, equipment related to boats, outdoor recreations, and or survival is integrated into pre-determined positions within the nested hull sections to form a complete kit.

In one embodiment, the vessel further includes an inward extending gunnel extending about the upper edges of the front and aft hull sections and the upper edges of the side panels. In another embodiment, the side panels include a compound curvature conforming to a general hull shape in assembly. In yet another embodiment, the material section is one or a combination of a nylon or polyester fabric coated with one of hypalon, neoprene, polyurethane, polyuria, or polyvinyl chloride (PVC). In one embodiment, the material section is connected at both ends to the outer edges proximal to the open ends of the front and aft hull sections via a water proof seam.

In one embodiment, the front and aft hull sections, floor boards, and side panels are molded from a fiberglass, carbon, or Kevlar reinforced polymer material. In one embodiment, the side panels on either side of the at least one cross rib member are orientated in assembly and held together by a slot and pin connection. In a preferred embodiment, the at least one cross rib engaged between side panels rotates down to both align the side panels in elevation and separation and seats against a floor board latch bar or catch interface forcing the floor boards down causing the material hull section to be taught about the entire frame assembly. In a variation of this embodiment, the side panels attach to the front and aft hull sections via a rotable pin-shelf joint interface.

In one preferred embodiment, the four or more side panels connect to each other using one or a combination of tongue and groove or interlocking tab connections and wherein the combined length of the connected panels exceeds the length of the material hull enabling tensioning of the sides of the material hull by urging the interlocked panels outward at the connection point. In one embodiment using a rotable pin shelves, the front hull and aft hull sections include opposing pairs of material stops formed by removing gunnel material to create relief for connecting the side panels to the hard-shell hull sections, the stops preventing the side panels from lifting up above the solid hull sections.

In a variation of the preferred embodiment using pin shelves, the pins installed in the pin joint angle slightly outward from the seat end of the pins further preventing upward drift of the side panels in assembly. In one preferred embodiment, the front hull and the aft hull section each include a floorboard tongue and groove bracket having one or more slot openings provided horizontally there through, the brackets disposed at the central bottom edge of the open end of the front and aft hull sections. In this embodiment, the first and last floorboards include a pair of material tongues extending horizontally out from one end, the tongues disposed centrally and spaced apart on the first and last floorboards to align with the bracket slots on the front and aft hull sections.

DETAILED DESCRIPTION OF THE INVENTION

The inventor provides a unique portable vessel that can be quickly assembled for use and then taken down for porting. The present invention is described in enabling detail using the following examples, which may describe more than one relevant embodiment falling within the scope of the present invention.

Figure 1:
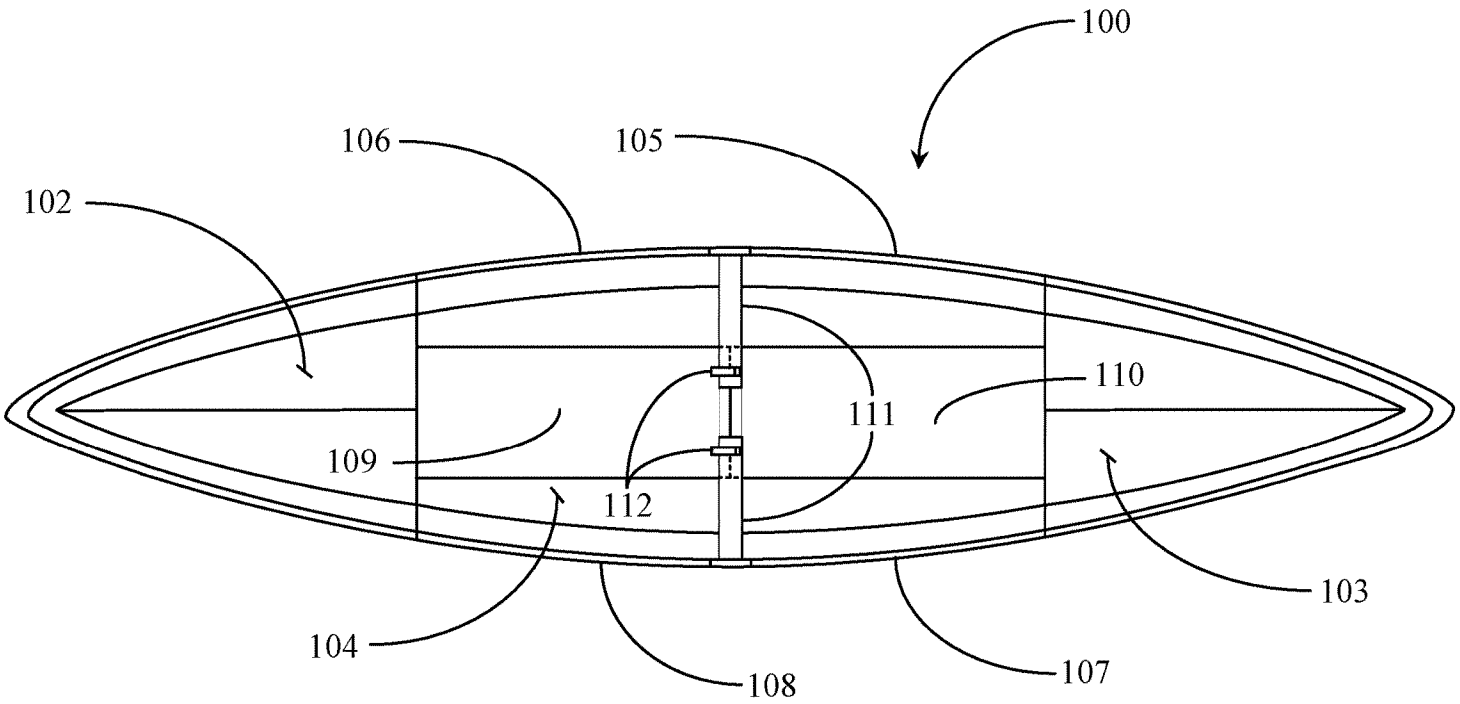
FIG. 1 is an overhead view of a portable canoe according to a simple embodiment of the present invention.

FIG. 1 is an overhead view of a portable vessel 100 according to a simple preferred embodiment of the present invention. Vessel 100 may be in the form of a canoe, a kayak, or a hybrid of the two without departing from the spirit and scope of the present invention. In one embodiment, vessel 100 may take the form of a raft. Vessel 100 includes three main sections termed hull sections in the art. Vessel 100 includes a front hull section 102, an aft hull section 103, and a flexible material middle hull section 104. Hull sections 102 and 103 are substantially a rigid polymer and may be manufactured from Kevlar (a synthetic fiber of high tensile strength used especially as a reinforcing agent in the manufacture of tires and other rubber products and protective gear such as helmets and vests), carbon fiber, fiberglass, composite material, Solid polymer, hollow polymer corrugated material with internal structural reinforcements, fiber reinforced polymer composite material or a composite material with low density core. Hull sections 102 and 103 may be solid or have hollow reinforced internal features or low density core material. In one embodiment hull sections 102 (front) and 103 (aft) are molded or vacuum molded parts.

Hull sections 102 and 103 may go from assembled to nested position by first a 180 degree rotation that aligns narrow ends of the hull sections and second a translation that nests the two hull sections together by some combination of sliding the components together lengthwise or by placing one component over the top and down into the other component. Hull sections 102 and 103 are interconnected by a resilient material forming a material hull 104. The flexible material hull 104 remains attached to the front and aft hull sections during assembly and disassembly and experience both a twist and a fold in nested position. Hull sections 102 and 103 may be adapted to accept snap on components such as a top covering, a cross bar, or a rail (not illustrated). In this embodiment hull sections 102 and 103 are identical and reversible. In another embodiment, hull sections 102 and 103 are of varying lengths, and or widths necessitating that the hull of lesser dimensions may be nested into the hull of greater dimensions.

Material hull or (middle hull) section 104 has a waterproofed seam connection to front hull section 102 and to aft hull section 103. Middle hull section 104 may be manufactured of one or a combination of nylon, polyester, hypalon, neoprene, polyurethane, polyuria, polyvinyl chloride (PVC), or another suitable material that is water tight, flexible and may be folded down into a small space. Material 104 may be connected to the front and aft hull sections proximal to the edges of those sections via a water proof seam or seam-weld. In one embodiment the seam is permanent. In another embodiment the seam may be removed are reinstalled. In another embodiment, the seam is semi-permanent and the entire middle hull section 104 can be removed and re installed for servicing. In another preferred embodiment there is no seam and the material section is an integral part of the whole, constructed in the manufacturing process. Such seams, as discussed above, may be disposed on the top or bottom surfaces of the solid hull sections. Material 104 may be expanded into a hull shape with the aid of modular framing components that may be connected together to form a hull frame covered, at least on the bottom and sides of the hull frame by the material.

Vessel 100 exemplifies a four side-panel embodiment of the present invention. In this example side panels include a side panel 105 and a side panel 106 on one side of vessel 100, and a side panel 107 and a side panel 108 on the opposing side of the vessel. Side panels 105 through 108 may be composed of metal, polymer, composite material, and or other suitable materials as discussed above as in the materials composing the hard shell sections. In one embodiment, side panels 105 and 106 connected each other and to the front and aft hull sections. In one embodiment, side panels 105 and 106, for example, connect to a rib component 111 proximal to the center of the material hull section in this example. Side panels adjacent to the hard-shell hull sections may have a different connection than one connecting two side panels together. More detail about how the panels connect to the hull sections and to each other is provided later in this specification. In one embodiment the panels and floorboards may be manufactured of a length that is slightly longer than the material hull fabric such that installation thereof into the framing apparatus contributes to tautness of the material making up the middle hull section.

Vessel 100 includes one or more floor boards (109, 110). Floor boards 109 and 110 may be removably connected to the front and aft hull sections 102 and 103. Floor board 109 may be connected directly to floor board 110 via an articulated or otherwise semi-flexible connection allowing for vertical movement of the floor boards at the connection point between the boards. Floor boards 109 and 110 may be molded or otherwise manufactured of a polymer, reinforced polymer, metal, composite material or other suitable material. Floorboards may also be constructed of the same material as the hard shell sections of the vessel as discussed above. One or more of the floor boards may include a relatively thick layer of cushioning or padding on the upper surface thereof for ergonomic user comfort when porting the vessel (described later in this specification) and for user comfort in operation of the assembled vessel.

In this embodiment, rib component 111 is provided both as a frame component that may be connected between side panels to separate them and as a tensioning component to hold down the floor boards and to separate the side panels simultaneously, such architecture providing sufficient structural integrity to the middle hull section including causing tautness to the material hull section in assembled position. Rib component 111 may be composed of metal, polymer, reinforced polymer, composite material, and or other suitable materials as discussed above concerning any of the other components of the vessel.

In this example, rib component 111 is connected on opposing ends to side panels such as to side panels 105 and 106 wherein the connecting apparatus at the end of the rib orientates and holds the side panels in adjacent orientation and provides separation tension between the interfaced side panels tightening the material hull 104. The rib component latches at the other end onto a catch plate or bar 112 fixed to one of the floor boards, in this example, floor board 109. Rib components 111 generally conform, whether curved or angled, to the profile of a side of the middle hull section. More detail about rib component 111 including how it may be used as a tensioning mechanism is provided latter in this specification.

In a preferred embodiment, vessel 100 may be disassembled by removing the frame members such as rib components, side panels, and floor boards. These components with the exception of the floor boards may fit within a nested configuration of the front and aft hull sections 102 and 103 along with the middle hull material 104. The nested hard-shell hulls may be covered by the one or more floor boards, the floor boards secured to the hulls using adjustable tension straps or mechanical means. The outward facing floor board may host a pair of shoulder straps, allowing a user to wear the disassembled vessel on the back while porting the vessel freeing up the users hands for other tasks. In one embodiment the hard-shell hull sections are hollow-walled or "double walled" or "corrugated" containing empty space for added buoyancy and reducing the weight factor of the vessel making it easier to carry.

Figure 2:
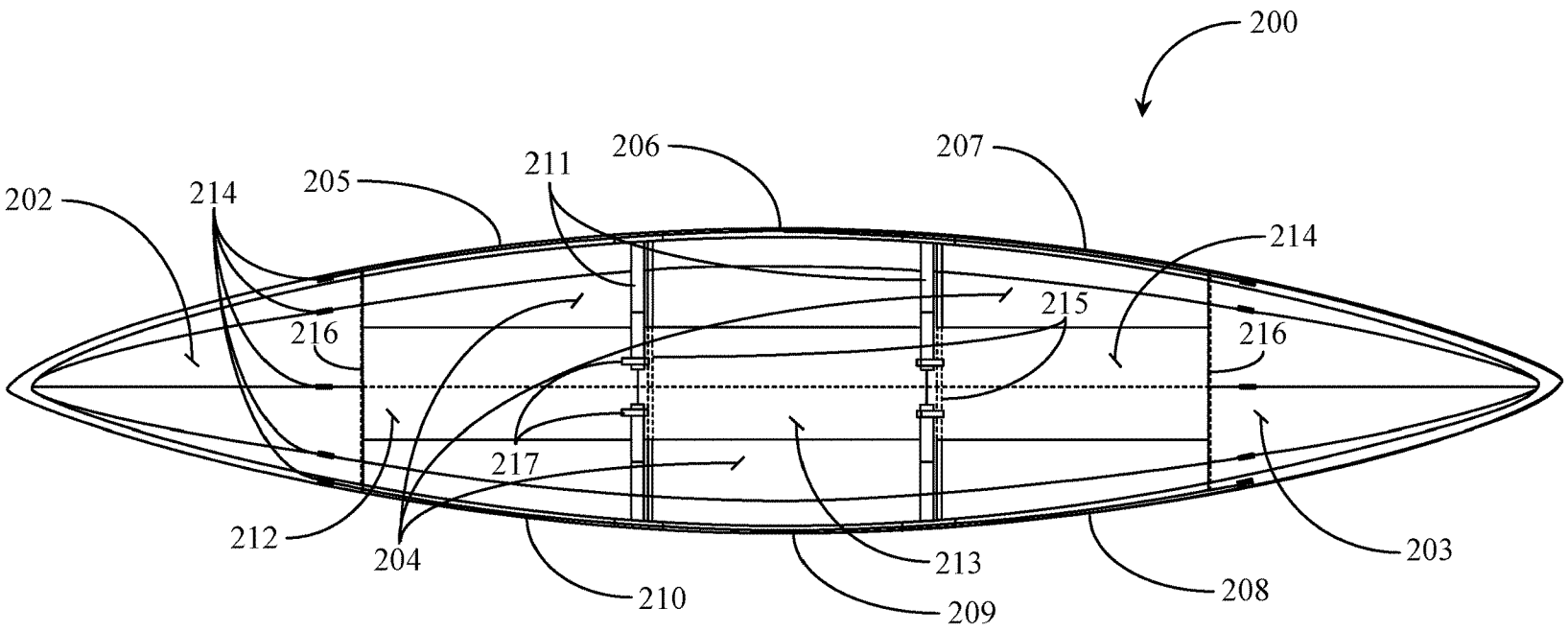
FIG. 2 is an overhead view of a portable canoe according to a variation of the embodiment of FIG. 1.

FIG. 2 is an overhead view of a portable vessel 200 according to a variation of the embodiment of FIG. 1. Vessel 200, like vessel 100 may be disassembled and ported in the form of a self-contained package or back pack. Vessel 200 includes hard-shell front and aft hull sections 202 and 203. Hull sections 202 and 203 may be identical or very similar to hull sections 102 and 103 of FIG. 1 both in form and materials and methods of manufacture mentioned further above. Vessel 200 includes a flexible middle hull material 204 that is representative of material 104 described further above. Material 204 may be constructed of any of the materials and may have any of the seam configurations discussed in relation to FIG. 1. In this example material 204 is seam connected in a water tight manner at the front and aft hull sections as described further above with respect to vessel 100 of FIG. 1. Material 204 wraps about the middle hull section frame including the side panels and the bottom hull frame members including the stringer members. In one embodiment vessel 200 is longer than vessel 100 described further above. For example, vessel 100 may have an overall assembled length suitable for one person to operate (one person vessel) while vessel 200 may be longer accommodating an operator and a passenger (two person vessel). Vessel 200 may also be configured to have two operators.

In this embodiment vessel 200 includes three side panels per side. A side panel 205, a side panel 206 and a side panel 207 comprise one side of the framework of middle hull section. A side panel 210, a side panel 209, and a side panel 208 comprise the opposite side of the middle hull framework. Side panels 205 through 210 of vessel 200 may be of the same material and manufacture as side panels 105 through 108 of vessel 100 FIG. 1. In this example the center side panels, panel 206 and panel 209 are configured differently for connection purposes. That is to say that the connection apparatus and method for connecting a side panel to a hard-shell hull section is different than the apparatus connection two side panels together, details of which are provided later in this specification.

Vessel 200 includes three floorboards, a floorboard 212, a floorboard 213, and a floorboard 214. Floorboards 212 through 214 may be of identical or similar form and manufacture as floor boards 109 and 110 described above with reference to FIG. 1. One or a combination of floorboards 212 through 214 may be padded or cushioned on one side for comfort during porting and during operation of and portage of the vessel as discussed in referenced to FIG. 1.

In this embodiment vessel 200 includes two ribs 211. In this example, floor boards 212 and 214 include catch plates or catch bars 217 one to accommodate each rib component 211. Floorboards 212 and 214 may be interchangeable in assembled position. In this example, floorboard 213 is a center floorboard that may not include a clasp or catch bar. The rib components latch the side panels bringing them into correct orientation with an amount of separation (between the panels) and apply tension against the floor boards at their junctions such that the rib interfaces two floorboards equally when fully latched beneath latch bar 217. In one embodiment, a single rib component may extend the full hull profile and may orientate the side panels on both sides of the vessel wherein the center portion of the rib may be latched in the same fashion as "half rib" components (211). In one embodiment only one of the rib components may be used for tensioning the middle hull material. In one embodiment half rib components may be implemented in place of a single full-hull rib component without departing from the spirit and scope of the present invention.

In this embodiment an additional framing component includes stringers 214. Stringers are known in the marine industry as narrow longitudinal frame members usually for supporting and shaping outer skin of a vessel. In this example, vessel 200 has four stringer members 214. There may be more or fewer stringer members 214 without departing from the spirit and scope of the present invention. Stringers may also be used in a horizontal or vertical position or a combination of both. Stinger members are not required to be present in the vessel architecture in order to practice the present invention.

In one embodiment stringers 214 are connected to the front and aft hull sections at their opposing ends. In this example there is a pair of stringers 214 attached to a gunnel, which is the inward extending lip about the top most edge of the hull sections, the gunnel lip formed in the side panels as well as the front and aft hull sections so as to form a full gunnel when vessel 200 is assembled. In one embodiment stringers 214 are provided in sections that may be affixed to one another in a similar fashion as tent poles are including an internal cord or cable that keeps the sections of one stringer together. In one embodiment stringers 214 may have sections that are hinged or otherwise flexibly connected so that they may be collapsed and stored within the nested hull sections when not in use. In one embodiment, stringers are straight and bend to conform to the hull shape upon assembly. In another embodiment, stringers are pre-bent to contour the hull. In another embodiment stringers are an integral part of the flexible material.

In this example at least one stringer harness 215 (two in this example) is installed adjacent to rib components 211, generally conforming in installation to the shape of the hull of vessel 200. Stinger harnesses 215 may be manufactured of a resilient UV resistant polymer material or any material discussed in this specification concerning other parts of the vessel, which may or may not be reinforced material. Stringer harness 215 functions in this example to space the stringers that are inside of the vessel apart from one another and direct the bow of stringers outward and downward against the middle hull material 204 helping it to retain a taught state. In one embodiment, snap recesses, clamps or other retaining features hold or retain the stringers in position. The features strategically spaced apart to correctly position the stringers for frame support. In another embodiment, stringers slide through partial or full length sleeves on the inner surface of the flexible material hull section 204.

In this example two of the stringers 214 are installed on top of the vessel gunnel. This configuration enables material hull 204 to be connected at both sides of the hull to the two gunnel stringers by way of material sleeve or another suitable connection method or hardware. In this way middle hull material 204 may not slip down from the top sides of the hull of vessel 200. It should be noted herein that in a vessel without stringers, the material of the middle hull section may be held up by the side panels via a sleeve or other type of connection to prevent downward drift of the material during use of the vessel. In a preferred embodiment without stringers along the gunnels, a series of catches affixed to the material hull catch to the inner edge of the inward extending gunnel and prevent downward drift of the material hull in relations to the side panels. In another preferred embodiment a cable, strap, or other reinforcement runs along the edge of the material hull and may pull the material hull taught over the top edge of the side panels preventing downward drift.

Figure 3:
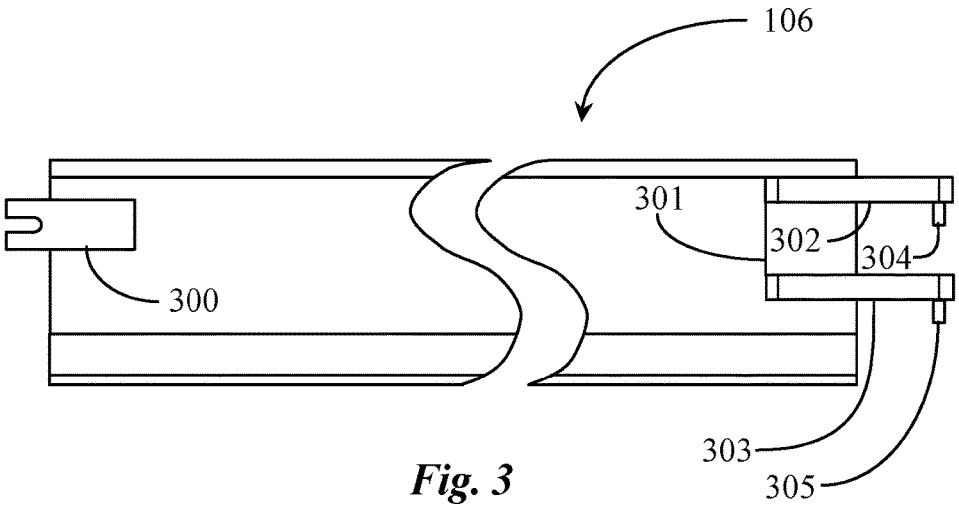
FIG. 3 is a side elevation view of a side panel of FIG. 1 depicting connection components according to one embodiment of the invention.

FIG. 3 is a broken side elevation view of side panel 106 of FIG. 1 depicting connection components according to one embodiment of the invention. Side panel 106 includes a connection plate 300 including an elongate slot that is open at one end. Plate 300 may be fabricated of aluminum or some other resilient metal or a polymer material. It is noted here, to reduce redundancy, that any part of this vessel in any embodiment of the vessel in this specification can be made of any material discussed in this specification concerning any other part of this vessel. Component 300 interfaces with a pin or dowel at the interfacing end of a rib component such as component 111 of FIG. 1. The other end of panel 106 connects to the aft hull section in this case via a support plate 301 having at least two parallel connection arms, connection arm 302 and connection arm 303. Support plate 301 with connection arms 302 and 303 may be a contiguous part that is molded from a polymer or machined of a metal or other material including, perhaps a polymer material.

Connection arms 302 and 303 extend laterally and in parallel in the same plane past the edge of side panel 106 and may be connected to a like number of pin seats in a pin-joint connection. Pin seats are openings provided through brackets near the edge of each solid hull section on either side. Connection arm 302 includes a pin or dowel 304. Connection arm 303 includes a pin or dowel 305. A side panel may swing inward into the internal space of the hull section of the vessel from the "pin joint" connection incorporating connection arms 302 and 303 with pins 304 and 305. The side panel may be urged in this semi-rotatable position toward a rib component that will retain it into position within the hull frame. That is to say the side panels may be connected to the front and aft hull sections before being forcibly oriented in place by a rib component. In one embodiment the overall length of the side panel is shorter than that of the front and aft hull sections so that they may be stored within the nested hull sections.

Figure 4:
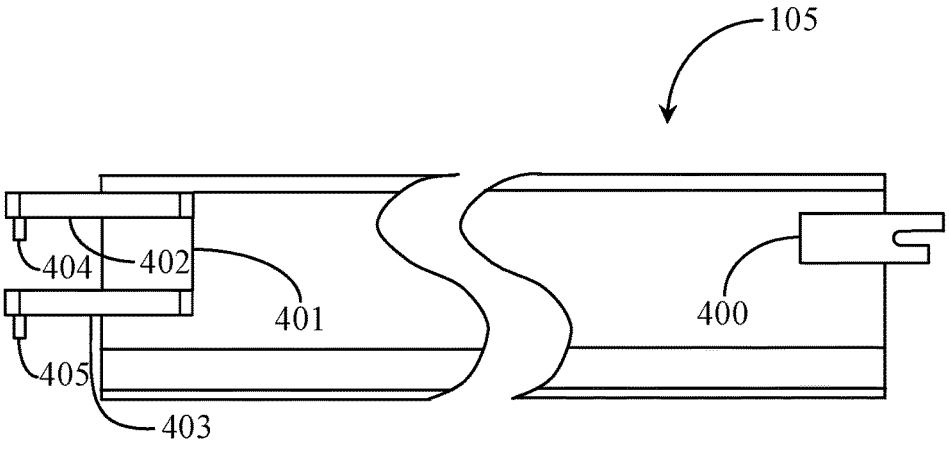
FIG. 4 is a side elevation view of a side panel that connects to the side panel of FIG. 3.

FIG. 4 is a broken side elevation view of side panel 105 that connects to side panel 106 of FIG. 3. Side panel 105 includes a connection plate 400 including an elongate slot that is open at one end. In this example the slot has one side extending further than the end of the slot. In one embodiment this longer slot wall extension aids in catching the panel with the pin or dowel on the rib component. Plate 400 may be fabricated of aluminum or some other resilient metal or a polymer material or any other material discussed herein. Component 400 interfaces with a pin or dowel at the interfacing end of a rib component such as component 111 of FIG. 1. In one embodiment the first panel engaged is the one with the shorter slot. The other end of panel 105 connects to the front hull section in this case via a support plate 401 having at least two parallel connection arms, connection arm 402 and connection arm 403. Support plate 401 with connection arms 402 and 403 may be a contiguous part that is molded from a polymer or machined of a metal or other material including, perhaps, a polymer material or any other material discussed herein Connection arms 402 and 403 extend laterally and in parallel in the same plane past the edge of side panel 105 and may be connected to a like number of pin seats in a pin-joint connection. Pin seats are openings provided through brackets near the edge of each solid hull section on either side. Connection arm 402 includes a pin or dowel 404. Connection arm 403 includes a pin or dowel 405. A side panel may swing inward into the internal space of the hull section of the vessel from the "pin joint" connection incorporating connection arms 402 and 403 with pins 404 and 405. The side panel may be urged in this semi-rotatable position toward a rib component such as rib 111 or 211 that will retain it into position within the hull frame. That is to say the side panels may be connected to the front and aft hull sections before being forcibly oriented in place by a rib component. In one embodiment the overall length of the side panel is shorter than that of the front and aft hull sections so that they may be stored within the nested hull sections.

Figure 5:
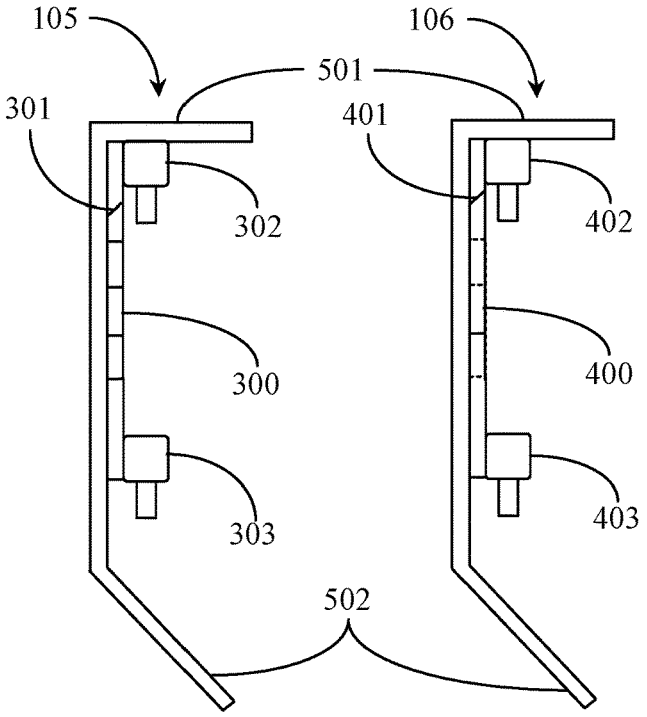
FIG. 5 is an end view of the side panels of FIG. 2 and FIG. 3 depicting an inward gunnel and straight angle inward bend.

FIG. 5 is an end view of side panels 105 and 106 of FIG. 1 depicting an inward gunnel and straight angle inward bend. Side panels 105 and 106 include a gunnel lip 501 formed along the entire top edge of the panel. Gunnel lip 501 may be a molded feature of the side panel component. Connection components such as support plates 300 and 400 with extension arms 302 through 403 with downward emerging pins. Side panels 105 and 106 include an angle bend 502 along each lower edge of each panel. Angle bend 502 may be formed as in bending the material or molded. The inward angle of the side panels may vary according to hull style, which may dictate the shape of the panel along its lower edge. In this example the angle is proximal to about forty five degrees from horizontal.

Figure 6:
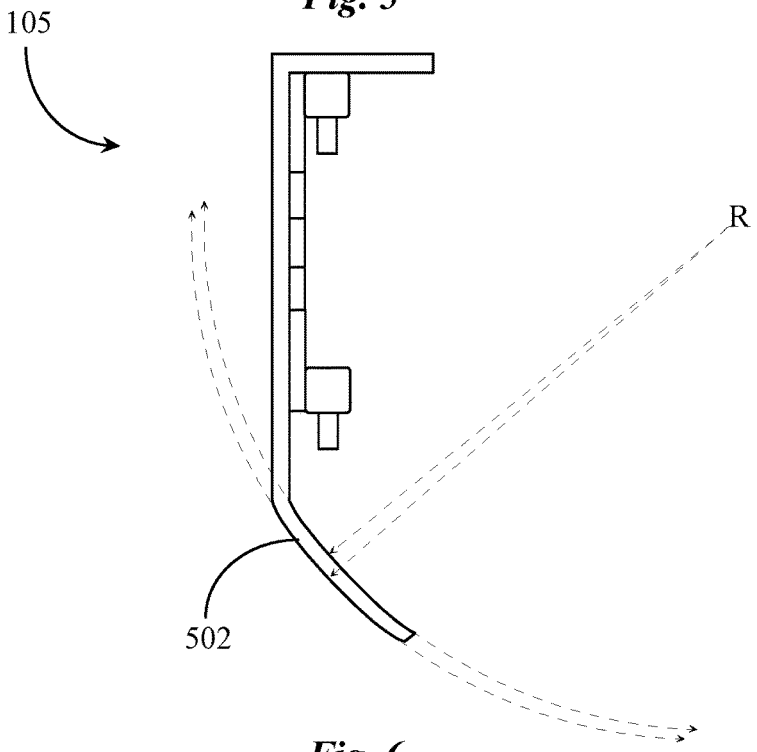
FIG. 6 is an end view of the side panel of FIG. 2 or FIG. 3 depicting an inward gunnel and an inward compound curvature.

FIG. 6 is a broken end view of side panel 105 of FIG. 1 with an inward extending gunnel and an inward compound curvature for feature 502. In one embodiment, side panel 105 may have a compound curvature in place of a straight angle bend such as bend 502 of FIG. 1. The exact radius of the compound curvature may vary according to style preferences without departing from the spirit and scope of the present invention. In this example, radii R are taken from approximate center point or just above the center point of the hull configuration. In one embodiment the side panels may assume a negative draft angle and curvature, which is a popular style with canoes and kayaks for example. Other shapes and amounts of curvature and the extension thereof along the panel profile may be observed without departing from the spirit and scope of the present invention.

One with skill in the art of component connectors and fasteners will agree that there may be a variety of other ways to interconnect the side panel frame components in vessels 100 and 200 without departing from the spirit and scope of the present invention. The inventor has chosen the aforementioned connecting features and method of assembly, described in more detail later in this specification because the use thereof provides a tensioning mechanism for the middle hull fabric to keep it taught about the frame components while the vessel is in use. It will be appreciated by one with skill in the art that the overall length dimensions of the side panels, floorboards, and stringers, if present, is such that directional tensioning is a result of assembly of the components together with the material of the middle hull first positioned to be tensioned by the assembly.

Figure 7:
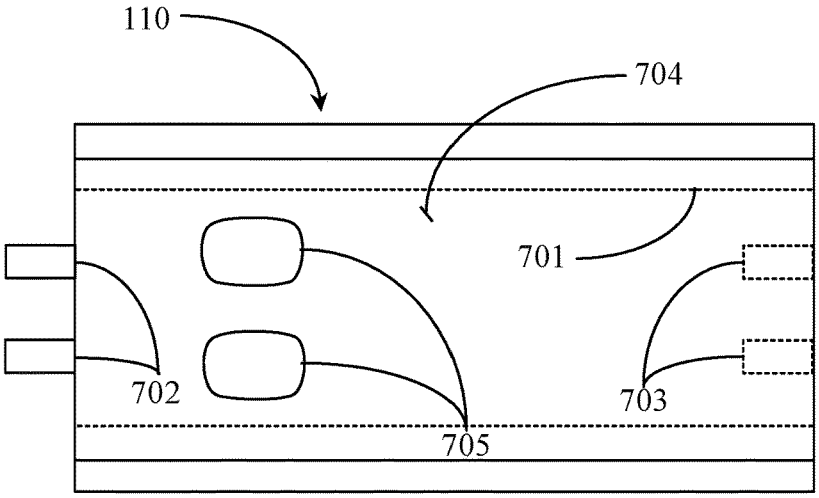
FIG. 7 is an overhead view of a floor board of FIG. 1 depicting tongue and groove connection components, knee depressions in over laid material, and straight angle upward bends at each longitudinal edge.

FIG. 7 is an overhead view of floorboard 110 of FIG. 1 depicting tongue and groove connection components, knee depressions in over laid material, and straight angle upward bends at each side edge. Floorboard 110 may represent any of the floorboards in vessel 100 or in vessel 200 that does not include one or more catch plates or bars for accepting a rib component to apply downward tension on the floorboards. Floorboard 110 has tongue-in-groove connection components depicted herein as tongues 702 and grooves 703. Tongues 702 may be molded into the floorboard and may be somewhat articulate or flexible. Grooves 703 may be molded into the floorboards and are sized in dimension to accept insertion of tongues 702. In this example tongues 702 may fit into grooves on an adjacent floorboard such as floorboard 109 of FIG. 1 for example. Grooves 703 may accept tongue extension on aft hull 103 of FIG. 1. In vessel 200 floorboard 110 is most like floorboard 213 because it lacks the catch bars.

Floorboard 110 has a layer of material that in one embodiment may be flotation material 704 that may also provide some ergonomic cushioning for a vessel operator and porter. Material 704 may be manufactured of a semi-soft foam material or a form of polymer that may provide ergonomic cushioning and or buoyancy. In one embodiment material 704 may be a molded piece that is affixed to floorboard 110 using a glue or resin or physical fasteners. In this example material 704 spans the length of floorboard 110 and extends past bend lines (broken lines) proximal to each long edge of the board. In this example the floorboard is formed or otherwise bent along the edges to generally conform to a hull shape in line with the bends on the side panels.

In this embodiment material 704 includes at least two indentations 705 in the material that are adapted to ergonomically receive the knees of a vessel operator to provide a degree of comfort while paddling the vessel. In the case of a two person vessel, there may be two central floorboards having material with indentations like floorboard 110. Another function that material 704 may provide is use of the floorboard as a flotation device in case of an accident. Yet another function of the material may be to provide ergonomic comfort for an operator porting the vessel and using the floorboard with the material side out over the nested hulls in the backpack configuration mentioned above. In this embodiment there may be a molded conformity in the layer of padding or cushioning that may conform to the natural shape of a user's back. Material 704 may be UV resistant and may include safety information, insignia, or instruction printed thereon such as identification as a flotation device, for example.

One with skill in the art of tongue and groove connection components will appreciate that there may be only one tongue and groove or multiple tongues and like number of grooves for adjoining the floorboards without departing from the spirit and scope of the present invention. There may be a variety of other ways to connect the floorboards together such as snap connectors, hinged connections, pin and seat connections, etc. In a preferred embodiment the connection is somewhat pliable so that the connected boards may be angled somewhat while still connected and without damaging the connection components.

Figure 8:
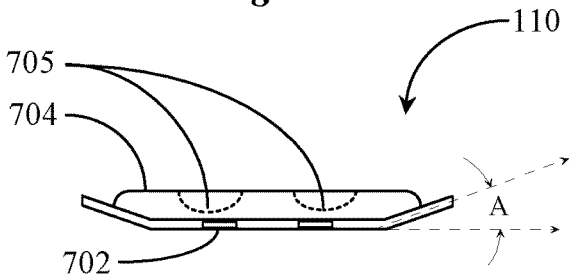
FIG. 8 is an end view of the floor board of FIG. 8.

FIG. 8 is an end view of the floorboard 110 of FIG. 8. Floorboard 110 is depicted in end view to depict the angle of bend at each longitudinal side thereof. In this case the sides are formed at an angle A from horizontal of approximately thirty degrees. Angel A may be more or less than 30 degrees dependent in part on the desired hull shape design of the vessel. In one embodiment the width dimension of floorboard 110 is just smaller than the gap between the bottom edges of the side panels in assembly. Floorboards such as floorboard 110 are durable and stiff enough to support the weight of a user without bowing. One or more boards in a given vessel may have flotation material affixed thereto and may be used as a flotation device. In one embodiment a vessel such as vessel 100 or vessel 200 may also include at least one seat board that may be installed after assembling the middle hull frame. Such as seat board may also have flotation material affixed thereto and might also or instead be used as a flotation device.

Figure 9:
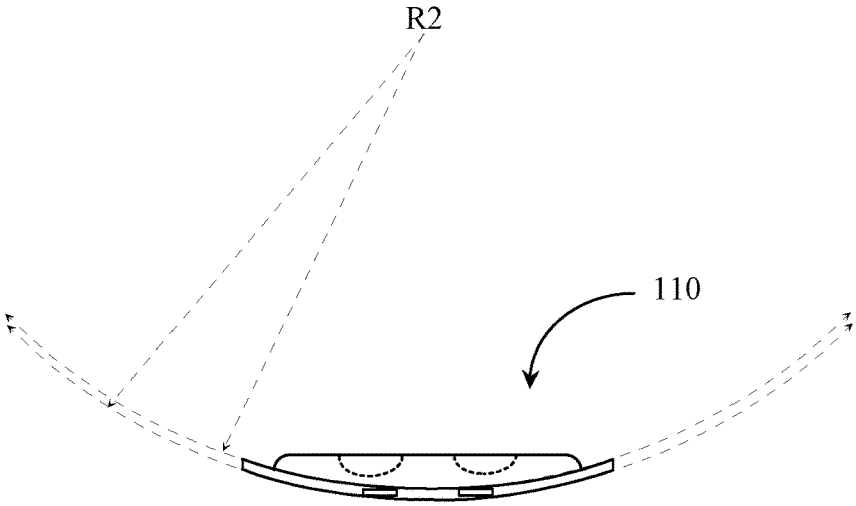
FIG. 9 is an end view of the floor board of FIG. 9 with a compound curvature.

FIG. 9 is an end view of floorboard 110 of FIG. 8 with a compound curvature. In this example floorboard 110 has a compound curvature in place of angled longitudinal edges. In this example the radii may be taken from the proximate center of the hull shape or just above center. It is noted that the curvature of the floorboards and side panels are complimentary in conforming to the general shape of the middle hull. In an embodiment without stringers, the middle hull material resides on the outside of the framing components including the side panels and floorboards. In a variation of this embodiment streamlining features such as an angled ridge or water passage grooves may be applied to help the hull material conform to a more desirable shape below the waterline when the vessel is in use. Many different hull shapes and styles may be envisioned without departing from the spirit and scope of the present invention.

Figure 10:
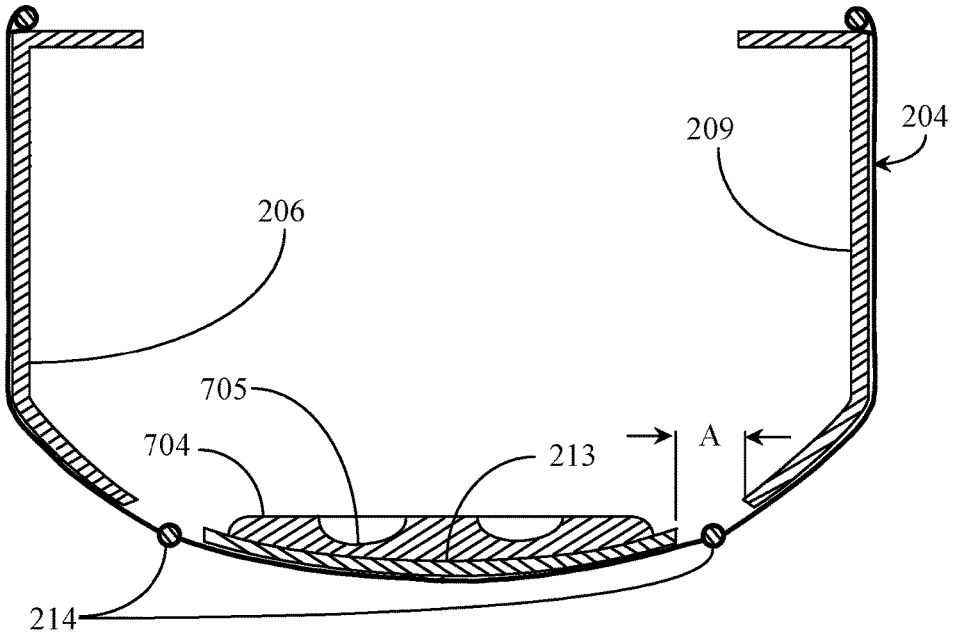
FIG. 10 is a sectioned view of a middle hull of FIG. 2 with compound curvature and stringers.

FIG. 10 is a sectioned view of a middle hull of FIG. 2 with compound curvature and stringers. The middle hull section includes side panels 206 and 209 and floorboard 213 in this sectioned view. In this example, the general hull shape includes curvature in the side panels and floorboards. Connection components are not illustrated in this view for clarity. Material 704 includes indentations 705 as depicted further above in FIG. 8 and may also include a surface feature that conforms somewhat to a user's back so that the user may more comfortably port the vessel in back pack mode.

In this exemplary configuration stringers 214 may be inserted through sleeves, straps, or passageways strategically provided proximal to the edges and along the other "stringer" paths of hull material 204. The sleeves provide the lateral separation of the stringers and may be utilized in place of one or more stringer harnesses such as harness 215 of FIG. 2. Stinger harness or spreader 215 may reside on the inside of the material hull, rib components, and or between stringers. Stringer components 214 may be inserted through the middle hull material via sleeves. The length of the sleeves may be significantly less that the entire length of the middle hull material section so that the stringers at the top on the gunnels can be snapped onto or into stringer seats (not illustrated) fixed along the gunnel in the middle section.

Tensioning of the middle hull frame causes the middle hull material to be taught against the side panels and floorboards. In a preferred embodiment this is achieved in one motion by connecting the rib component to the side panels and rotating the rib component down to latch against the floor boards. In a variation of this embodiment the rib component comprises two half rib components that are diametrically opposed in assembly and that may each be used collaboratively to connect and orientate (with separation) the side panels and to provide down force on the floor boards tensioning the material about the middle hull frame.

In the embodiment with stringers, stringers 214 located at the bottom in this view fill in between gaps that may exist between the side panels 204 and floor board 213 referenced herein as gap A. Gap A may vary from a few inches to several for a larger vessel. Stingers may add to the structural integrity of the middle hull in this embodiment.

The stringers at the top of the vessel prevent the material from drifting downward during use in water. In an embodiment without stringers sleeves placed at the edges of the material of the middle hull section may be inserted over the side panel extension arms before they are placed into pin shelves or seats affixed to the front and aft hull sections. Moreover, there are other fastening techniques that may be used to secure the middle hull material to the gunnel of the vessel so that it prevents the material from drifting down or losing tension in any way.

In the example, floorboard 213 and side panels 206 and 209 share a compound curvature representing an exemplary shape of the hull bottom. Stringers 214 may come in sections that are connected together. The sections may be shorter than the length of the front and aft hull sections and thus may be stored within the provided space during porting the vessel disassembled and converted into the form of a pack that can be worn on the user's back.

Figure 11:
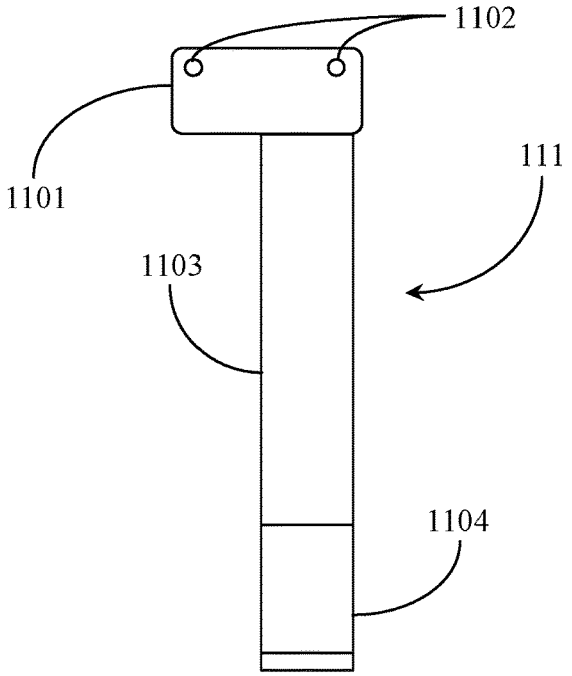
FIG. 11 is a front elevation view of a rib component of FIG. 1 according to an embodiment of the present invention.
Figure 12:
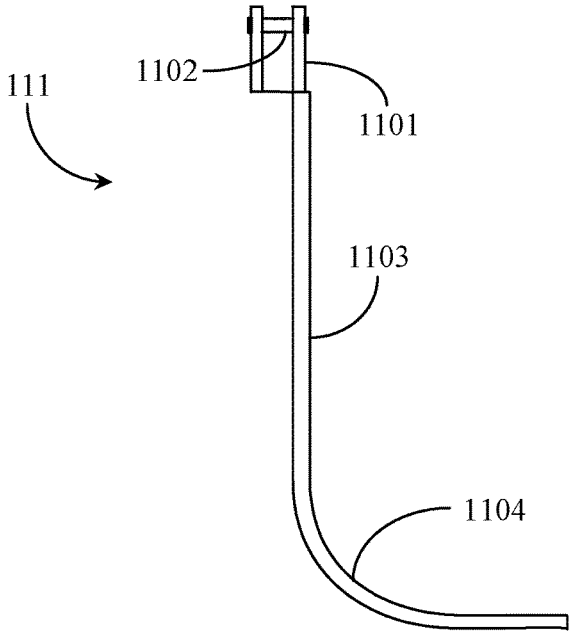
FIG. 12 is an end view of the rib of FIG. 11.

FIG. 11 is a front elevation view of rib component 111 of FIG. 1 according to an embodiment of the present invention. FIG. 12 is an end view of the rib of FIG. 11. Referring now to FIG. 11, rib component 111 includes a head portion 1101, a middle portion 1103, and a tail portion 1104. Rib 111 may be molded from a durable polymer material that may include reinforcement material such as Kevlar or carbon fiber, or some fiberglass composite or any material discussed herein. It is noted that other relatively light weight but durable materials may be used without departing from the spirit and scope of the present invention.

Head portion 1101 of rib 111 includes two posing connection plates (one visible in this view) connected together via pins 1102 leaving a uniform gap in between the plates. Pins 1102 are adapted to capture the side panels at the slot extensions of the side panels. The overall length of the side panels causes them to be sufficiently close together at the interfacing ends such that the rib component is first turned at an angle to engage the side panel slots before being rotated into assembly position separating the panels and tensioning the middle hull material at the sides. In one embodiment, the panel with the even slot (one without extended side) is captured first by the head portion of the rib component.

The overall length of rib component 111 may be just longer than the distance between the point of interface on the side panel and the catch interface at the floorboard so that the rib will produce tension in the material of the middle hull when rotated into position to catch at the floorboard interface. In this way rib 111 functions as a tensioning component urging the side panels apart while keeping their orientation and urging the floorboards down simultaneously providing a taught state for the material 204 of the middle hull.

In FIG. 12, tail portion 1104 of rib component 111 transitions from the side of the middle of the hull toward the middle portion of the bottom of the hull. This may be accomplished with a straight angle bend or with the curvature. Pins 1102 span the inside gap between the head-connection plates. Pins 1102 may be steel pins, polymer pins, or pins or dowels of other materials so long as they are durable. Pins 1102 engage slots at the connection plates of the side panels in this embodiment. The at least top of head portion 101 may be open to allow the angled engagement of the rib components to adjacent ribs.

In this example rib 111 has a compound curve at tail portion 1104. The edge of tail portion 1104 may extend just short toward the center line of the middle hull where there is a catch bar to hold it down against the floor boards. In one embodiment side panels are prevented from drifting upwards in assembly by gunnel material at the front and aft hulls where the panels connect to them. It is noted herein that variations on a general hull shape may be observed during the molding and or manufacturing process of the side panels so that classic hull shapes may be reproduced in the middle hull section for conformity and intended function relative to performance through water. For example, the hull shape of a kayak may be different from that of a standard canoe and a hybrid (canoe/kayak) may incorporate elements of both hull shapes. These considerations may be designed into the side panel and floorboard shapes as well as in the rib components and stringer harnesses if employed.

Figure 13:
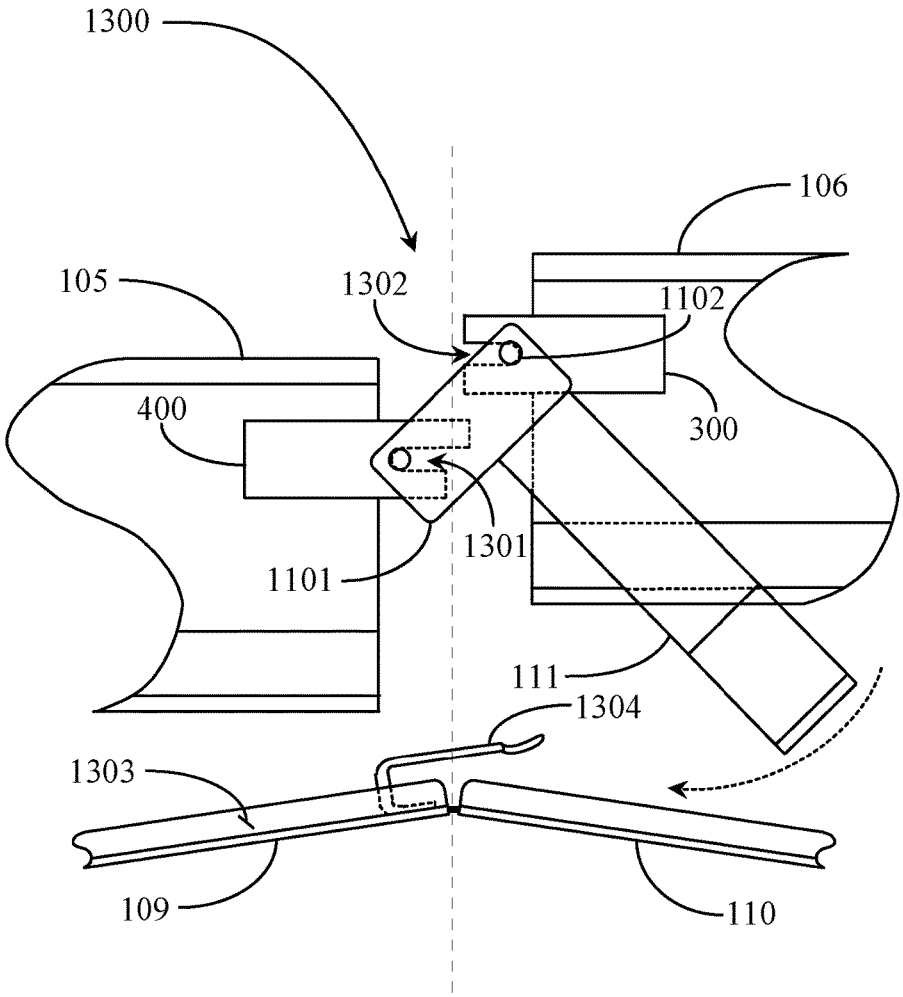
FIG. 13 is a front elevation view of a fabric tensioning mechanism for achieving a taught state of the material about the middle hull frame components.

FIG. 13 is a front elevation view of a material hull 104 tensioning mechanism 1300 for achieving a taught state of the material about the middle hull frame components. Mechanism 1300 comprises rib component 111 as a primary actuator or lever for "catching" the side panels, in this case side panel 105 and side panel 106 depicted in broken views. To corral the side panels, rib components 111 may be presented at an angle of about 45 degrees more or less to capture the side panels with pins 1102 engaged fully in slots 1301 and 1302.

Mechanism 1300 also includes floorboards 109 and 110 inter connected and in position (angled up) to be tensioned. The act of tensioning is to rotate rib component 111 down to vertical once the pins are fully engaged in the slots on the side panels which are already connected to the front and real hull sections. Bringing rib component 111 down to a vertical position results in pushing down on the floorboards to tension the bottom part of the hull material. The rib component may be retained in this position by a catch plate or bar 1304. Rib catch 1304 is mounted to floorboard 109 and may extend along the length of the hull past the junction between boards 109 and 110 in order to capture the tail portion of rib component 111 over the connection point at the junction between the floorboards or may be oriented further back on floorboard 109 so that the catch does not extend over the floorboard junction or may be oriented in the other direction. In a preferred embodiment, the tail portion of the rib is presented in the opposite rotational direction presented in FIG. 13 and slides over only one floorboard on its path to the rib catch. In this embodiment, the rib catch is located near the junction of the two floorboards and the tail portion of the rib does not encounter the floorboard junction during assembly. Rib catch 1304 may be fastened to the board surface and may extend upward through the material layer of the board. In one embodiment the rib component extends to both sides of the hull and has a center portion that latches against the floor boards.

It is noted again that the side panels as well as floor boards are manufactured longer in overall length each resulting in a collective assembled length of the components exceeding the overall length of the middle hull material enabling "forced" directional tensioning or "stretching" of the hull material about the frame to provide a taught skin about the framing components for the middle hull section. There may also be spacers insertable at connection points along the linearly connected side panels and floorboards to adjust tension as the material hull sections 104 expands or shrinks due to age, temperature, or other conditions. In one embodiment each side of the middle hull section frame is tensioned separately using a dedicated rib component at each side. In another embodiment, one rib component may be provided that has a head portion at each side and shares the tail portion between them spanning the whole of the hull shape. In one embodiment there may be only a single catch bar or plate in an embodiment using one rib component with two head portions at the ends. In another embodiment there may be two or more catch plates or catch bars provided to a single floorboard.

In this example a tongue-and-groove connection is used to connect floorboard 109 and 110 together. It is noted herein that other connecting hardware may be utilized without departing from the spirit and scope of the present invention as long as such hardware enables an articulate connection relative to angular movement where the boards may first present at an elevated angle within the hull without damaging or otherwise compromising the connecting components, and then be urged down and retained in a flat position by the rib component and catch bar.

Figure 14:
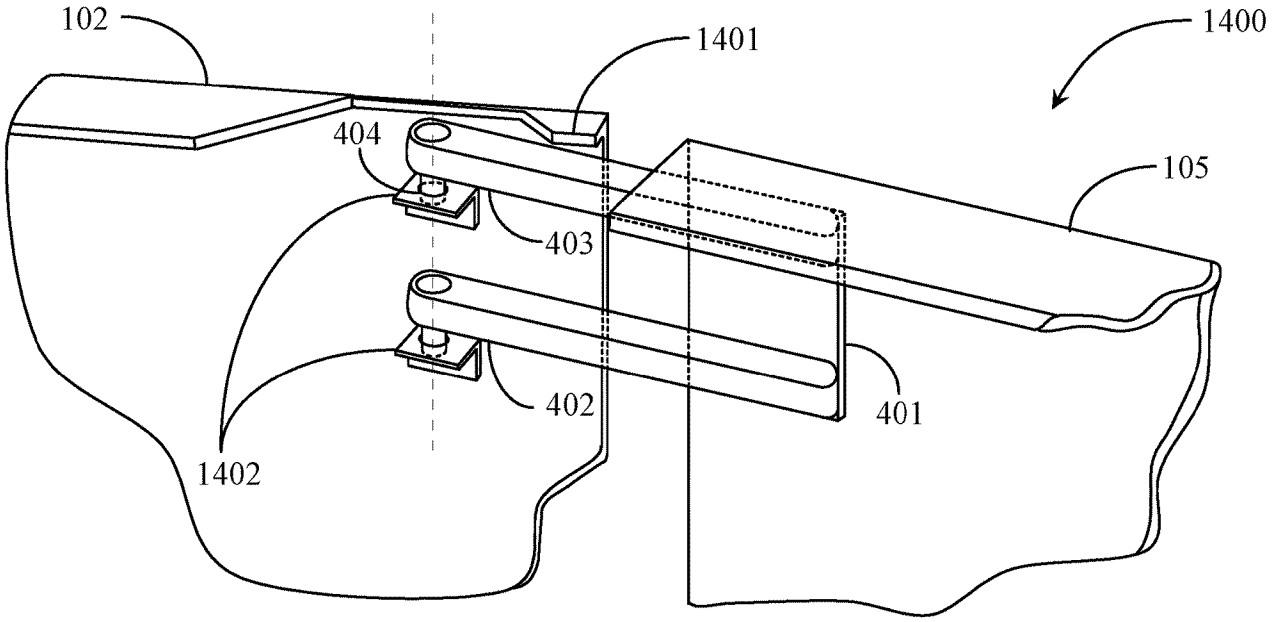
FIG. 14 is a broken view of connection of the solid hull section of FIG. 1 to a side panel of FIG. 1 according to an embodiment of the present invention.

FIG. 14 is a broken view 1400 of connection of solid hull section 102 of FIG. 1 to a side panel 105 of FIG. 1 according to an embodiment of the present invention. Side panel 105 connects in this example to front hull section 102 using a pin-joint connecting scheme that includes support plate 401 hosting extension arms 402 (lower arm) and 403 (upper arm). At the end of each extension arm there is a downward facing pin such as pin 404. On the hull section side a pair of pin shelves are provided to seat pins 404 during connection. Pin shelves 1402 are affixed directly to the front hull side wall at the inward surface. Shelves 1402 are vertically aligned and spaced apart to match the general spacing between the upper and lower extension arms of side panel 105.

In this embodiment a portion of gunnel material is absent as relief enabling unfettered attachment of pins 404 into the pin seats on pin shelves 1402. The panel (105) may be angled inward during attachment to a hull for convenience purposes. A portion of the gunnel material at the very end can function as a material or component stop 1401. Stop 1401 contacts the upper surface of the upper extension arm 403 and prevents side panel 105 from drifting upward after assembly. In this example the side panels are connected to the front and aft hull sections before being connected in the middle hull section.

It will be apparent to one with skills in the art of mechanical connections that there may be a number of different ways to physically connect the side panels to the hulls and to the rib components without departing from the spirit and scope of the present invention. The connection mechanics described in this specification with reference to the pin-joint connection apparatus and tongue and groove connections are examples that may also include hinged connections, spring-snap connections, interlocking "finger" joints, etc. The middle hull tensioning mechanism 1300 may use a variety of connection hardware as long as the functions of tensioning the sides and bottom portions of the material hull are unaffected.

Figure 15:
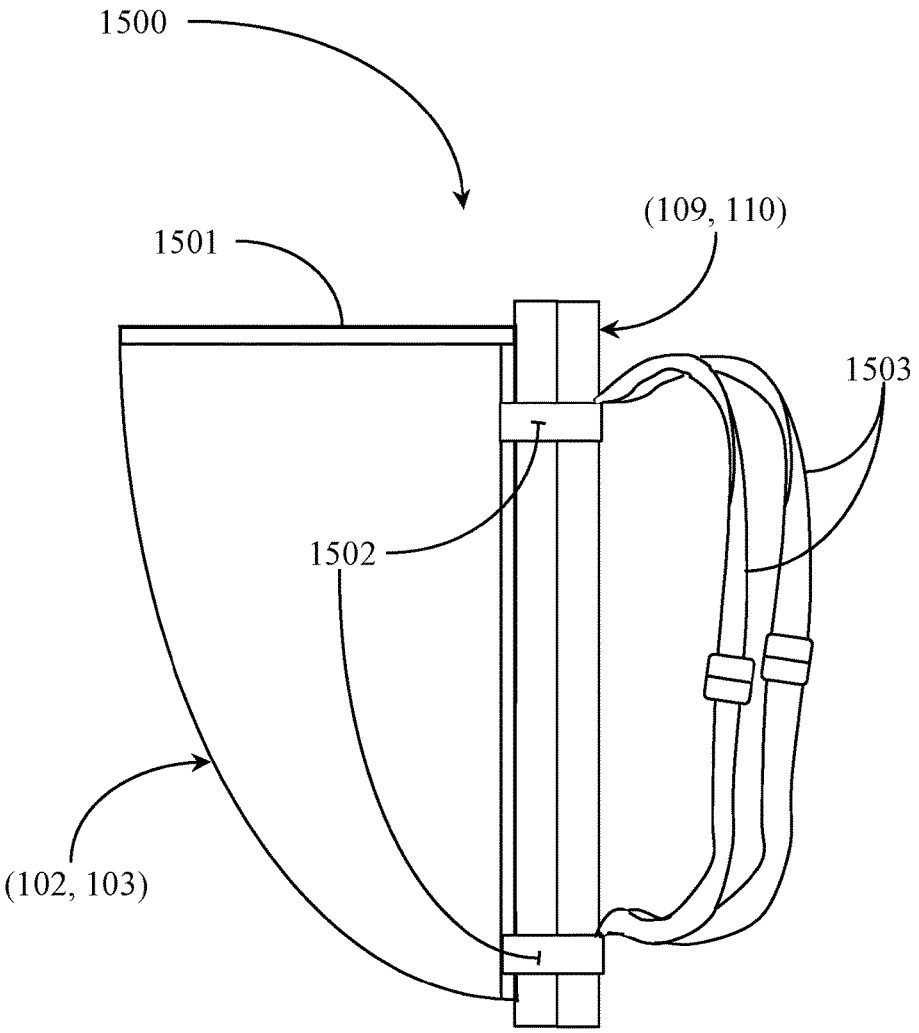
FIG. 15 is a portable vessel configured in the form of a portable back according to an embodiment of the present invention.

FIG. 15 is a portable vessel configured in the form of a portable back 1500 according to an embodiment of the present invention. In this "back pack" configuration example, aft hull sections 102 and 103 (nested together) form the storage area for the rest of the vessel components. Components that may be stored within the space of the nested hull sections includes, the material for the middle hull section (attached to both hull sections and fold-able therein) panels, rib components, stringers, stringer harnesses, etc.

It may be noted herein that other items typically associated with the vessel during use thereof may also be stored within the nested hulls such as clothing, food, tools, medical kit, fishing gear, and the like provided such items may fit or otherwise be made to fit within the storage area such as a telescopic or break-down fishing pole. Floorboards 109 and 110 may be stacked against the other and form a barrier over the normally open hull top blocking one open side of the nested hull sections. In another variation, the floorboards stow inside the nested hull sections and strap(s) pull the gunnels of the nested hull closer together to decrease the overall width of the package.

Tensioning straps 1502 may be provided that may be wrapped about the floorboards to secure them tightly over the nested hull sections. In one embodiment a top piece or snap on style lid 1501 may be provided to close off the portion of the hull that is normally open to the middle hull section. Shoulder carry straps 1503 may be provided and attached to the floorboards (109, 110) or tensioning straps 1502 to allow a single user to carry the vessel as a backpack freeing up the users hands for other purposes. In one embodiment back pack configuration 1500 may be structurally added onto such as adding one or more other space compartments and extending the height beyond top 1501 to accommodate other items typically ported on the back of a user in the field such as water, cooking utensils, tent and so on. In another variation, the front, pointed end of the nested hull section faces upward and may extend over the user's head during porting as a backpack.

Figure 16:
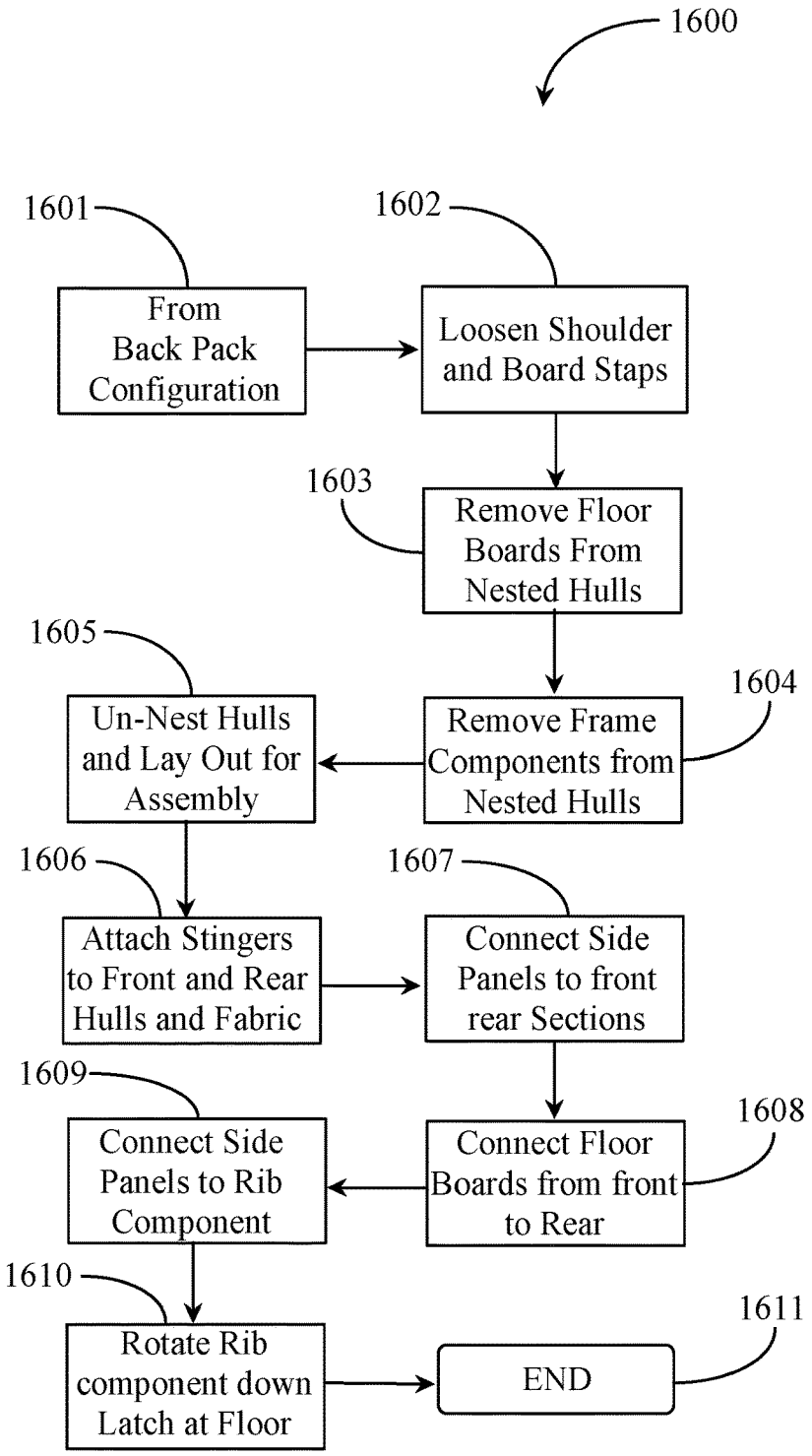
FIG. 16 is a process flow chart depicting steps for assembling a portable canoe for use in the field.

FIG. 16 is a process flow chart 1600 depicting steps for assembling a portable vessel for use in the field. At step 1601, the vessel is in a back pack configuration analogous to configuration 1500 described above. At step 1602 a user may loosen and or remove the shoulder and tension or board straps used in the back pack configuration. At step 1603 the user may remove the floorboards from the nested hulls. It is noted herein that in one aspect of the process, contents might be removed through the top of the backpack after removing the snap on lid that may function as a seat in the fully assembled vessel (FIG. 15, 1501).

The user may remove the frame components from the nested hulls at step 1604. Any other items packed in with the framing components may also be removed in this step. At step 1605 a user may unseat the nested hull sections and lay them out with the middle hull material for assembly. In this step the material naturally unfolds as it is connected to both hulls in a preferred embodiment. In an embodiment where stringers are used, they may be attached to the front and aft hulls and through the fabric sleeves at step 1606.

The user may connect the side panels to the front and aft hull sections at step 1607. The user may connect the floorboards from front to aft at step 1608. The vessel is now ready to be tensioned at the middle hull section. At step 1609 the user may connect the side panels to the rib component by catching the slots of the side panels with the pins on the head portion of the rib component. At step 1610, the user may turn the rib component to vertical position from the angled presentation and latch it at the floorboard catch bar in step 1610. The vessel is ready for use and the process ends at step 1611 for that vessel. Step 1610 provides a one-step method for tensioning the middle hull material about the framing components.

It will be apparent to one with skill in the art that the portable vessel system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention. The invention is limited only by the breadth of the claims below.

The invention claimed is:

1. A portable vessel, comprising:

a hard-shell front hull section;

a hard-shell aft hull section:;

a flexible water-tight material hull section affixed to the front hull section and the aft hull section in a water-tight manner, the material section forming the middle portion of the hull of the vessel; and a plurality of removable frame components comprising a frame assembly supporting the middle hull section in shape and structure;

wherein completion of the frame assembly causes tensioning of the material hull section from a less than taught state to a taught state about the frame assembly, wherein upon disassembly of the frame assembly, the middle portion of the hull is sufficiently flexible to allow the hard-shell front and aft sections to nest one inside the other without detachment of the middle hull section from the front and aft hull sections, and wherein the disassembled components of the frame assembly may be stored within the nested hull sections during transport.

2. The portable vessel of claim 1 wherein said frame assembly utilizes comprises one or more cross rib members, two or more floor boards and four or more side panels, and may include stringers.

3. The portable vessel of claim 1 wherein the nested hull sections are fitted with shoulder straps for porting on the back of a user.

4. The portable vessel of claim 1 wherein additional storage volume is allocated within the nested hull sections.

5. The portable vessel of claim 1 wherein floor boards may be secured over the nested hull sections with adjustable tension straps or a mechanical latch retaining other frame components within.

6. The portable vessel of claim 5 wherein one or more of the floor boards include a layer of padding material on at least one surface, and fasteners accepting connectors of adjustable shoulder carry straps.

7. The portable vessel of claim 6 wherein the padding material includes a conformity feature that conforms to a user's back for ergonomic porting.

8. The portable vessel of claim 6 wherein the padding material includes at least two indentations adapted to ergonomically interface the knees of an operator paddling the vessel.

9. The portable vessel of claim 1 further comprising an inward-extending gunnel extending about the upper edges of the front and aft hull sections and the upper edges of the side panels.

10. The portable vessel of claim 9 further comprising an inward-extending side edge of the material hull, extending over the top of the inward-extending gunnel.

11. The portable vessel of claim 10 further comprising a tensioning cable or stringer along the inward-extending edge of the material hull, optionally comprising a series of catches that catch on the inward extending gunnel.

12. The vessel of claim 1 wherein side panels and floorboards comprise a compound curvature conforming to a general hull shape in assembly.

13. The portable vessel of claim 1 wherein the material section is one or a combination of a nylon, polyester or polyvinyl chloride (PVC) fabric coated with one of hypalon, neoprene, urethane, polyurethane, polyuria, or PVC.

14. The portable vessel of claim 1 wherein the material section is connected at both ends to outer edges proximal to the open ends of the front and aft hull sections via a water-proof seam.

15. The portable vessel of claim 1 wherein the front and aft hull sections and frame members are manufactured from a solid polymer, a hollow core geometry polymer, a reinforced polymer, fiberglass, Kevlar, Carbon fiber, composite material, or metal material.

16. The portable vessel of claim 2 wherein the side panels on either side of the at least one cross rib member are orientated in assembly and held together by a slot and pin connection.

17. The portable vessel of claim 16 wherein the at least one cross rib engaged between side panels rotates down to both align the side panels in elevation and separation and seats against a floor board latch bar or catch interface, forcing the floor boards down, causing the material hull section to be taught about the entire frame assembly.

18. The portable vessel of claim 2 wherein the side panels attach to the front and aft hull sections via a rotatable pin-shelf joint interface.

19. The portable vessel of claim 2 wherein the four or more side panels connect to each other using one or a combination of tongue and groove or interlocking tab connections, and wherein the combined length of the connected panels exceeds the length of the material hull, enabling tensioning of the sides of the material hull by urging the interlocked panels outward at the connection point.

20. The portable vessel of claim 2 wherein the front hull and aft hull sections include opposing pairs of material stops formed by removing gunnel material to create relief for connecting the side panels to the hard-shell hull sections, the stops preventing the side panels from lifting up above the solid hull sections in assembled position.

21. The portable vessel of claim 18 wherein the pins installed in the pin joint angle slightly, preventing upward drift of the side panels in assembly.

22. The portable vessel of claim 2 wherein the front hull and the aft hull section each include a floorboard tongue and groove bracket having at least one slot opening provided horizontally there through therethrough, the brackets disposed at the central bottom edge of the open end of the front and aft hull sections, and the front and aft floorboards comprise at least one material tongue extending horizontally out from one end, the tongues disposed centrally and spaced apart on the front and aft floorboards to align with the bracket slots on the front and aft hull sections.

23. The portable vessel of claim 1 wherein one or more of the separable parts are rendered buoyant.

* * * * *